US011118606B2

(12) United States Patent
Harimoto et al.

(10) Patent No.: US 11,118,606 B2
(45) Date of Patent: Sep. 14, 2021

(54) FLUID CIRCUIT OF AIR CYLINDER

(71) Applicant: SMC CORPORATION, Chiyoda-ku (JP)

(72) Inventors: Gohei Harimoto, Moriya (JP); Mitsuru Senoo, Moriya (JP); Yuto Fujiwara, Tsukubamirai (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 17/251,093

(22) PCT Filed: Jun. 7, 2019

(86) PCT No.: PCT/JP2019/022678

§ 371 (c)(1),
(2) Date: Dec. 10, 2020

(87) PCT Pub. No.: WO2019/240023

PCT Pub. Date: Dec. 19, 2019

(65) Prior Publication Data

US 2021/0131454 A1 May 6, 2021

(30) Foreign Application Priority Data

Jun. 13, 2018 (JP) ..... JP2018-113156

(51) Int. Cl.

| | |
|---|---|
| ***F15B 11/02*** | (2006.01) |
| ***F15B 11/06*** | (2006.01) |
| ***F15B 11/024*** | (2006.01) |
| ***F15B 11/044*** | (2006.01) |

(52) U.S. Cl.

CPC ..... *F15B 11/06* (2013.01); *F15B 11/024* (2013.01); *F15B 11/044* (2013.01)

(58) Field of Classification Search

CPC ..... F15B 11/02; F15B 11/044; F15B 11/0445; F15B 11/0413; F15B 11/04; F15B 11/024; F15B 11/06

See application file for complete search history.

(56) References Cited

U.S. PATENT DOCUMENTS 6,296,013 B1 * 10/2001 Hosono ..... G05D 16/10 137/493.7
2019/0277310 A1 9/2019 Takakuwa et al.

FOREIGN PATENT DOCUMENTS

| | | |
|---|---|---|
| JP | 52-042506 U | 3/1977 |
| JP | 55-055604 U | 4/1980 |
| JP | 2018-54117 A | 4/2018 |

OTHER PUBLICATIONS

International Search Report dated Sep. 3, 2019 in PCT/JP2019/022678 filed on Jun. 7, 2019, 1 page.

* cited by examiner

*Primary Examiner* — Abiy Teka
(74) *Attorney, Agent, or Firm* — Oblon, McClelland, Maier & Neustadt, L.L.P.

(57) ABSTRACT

A first fluid circuit is a fluid circuit of an air cylinder provided with an air cylinder with a first air chamber and a second air chamber that are defined by a piston; a switching valve that is switched between the drive step and return step of the piston; a first flow channel between the first air chamber and the switching valve; and a second flow channel between the second air chamber and the switching valve. Two speed control valves are provided in series in the second flow channel.

4 Claims, 7 Drawing Sheets

10A

10A

10A

10A

FLUID CIRCUIT OF AIR CYLINDER

TECHNICAL FIELD

The present invention relates to fluid circuits of air cylinders.

BACKGROUND ART

A fluid circuit described in Japanese Laid-Open Patent Publication No. 2018-054117 addresses problems in reducing the time required to return a fluid pressure cylinder as much as possible while saving energy by reusing discharge pressure to return the fluid pressure cylinder.

To solve the above-described problems, the fluid circuit described in Japanese Laid-Open Patent Publication No. 2018-054117 includes a switching valve, a fluid supply source, an exhaust port, and a check valve for supply. When the switching valve is in a first position, a first cylinder chamber communicates with the fluid supply source, and a second cylinder chamber communicates at least with the exhaust port. When the switching valve is in a second position, the first cylinder chamber communicates with the second cylinder chamber via the check valve for supply, and the first cylinder chamber communicates at least with the exhaust port.

SUMMARY OF INVENTION

The fluid circuit described in Japanese Laid-Open Patent Publication No. 2018-054117 is provided with a throttle valve on the path to the exhaust port. Thus, only the discharge rate from an air cylinder can be adjusted, and the supply rate to the air cylinder cannot be adjusted.

The present invention has been devised taking into consideration the aforementioned circumstances, and has the object of providing a fluid circuit of an air cylinder enabling supply rate to the air cylinder and discharge rate from the air cylinder to be adjusted independently and yet having a structure that can be simplified.

A fluid circuit of an air cylinder according to an aspect of the present invention comprises an air cylinder including a first air chamber and a second air chamber partitioned by a piston, a switching valve configured to switch between a position for a drive process of the piston and a position for a return process of the piston, a first flow path disposed between the first air chamber and the switching valve, and a second flow path disposed between the second air chamber and the switching valve. Two speed control valves (each including an adjustable throttle valve and a check valve) are disposed in series on the second flow path.

In accordance with the fluid circuit of the air cylinder according to the present invention, the supply rate to the air cylinder and the discharge rate from the air cylinder can be adjusted independently, and yet the structure of the fluid circuit can be simplified.

DESCRIPTION OF EMBODIMENTS

Preferred embodiments of a fluid circuit of an air cylinder according to the present invention will be described in detail below with reference to the accompanying drawings.

First, a fluid circuit of an air cylinder according to a first embodiment (hereinafter referred to as "first fluid circuit 10A") will be described with reference to FIGS. 1A to 4.

Figure 1B:
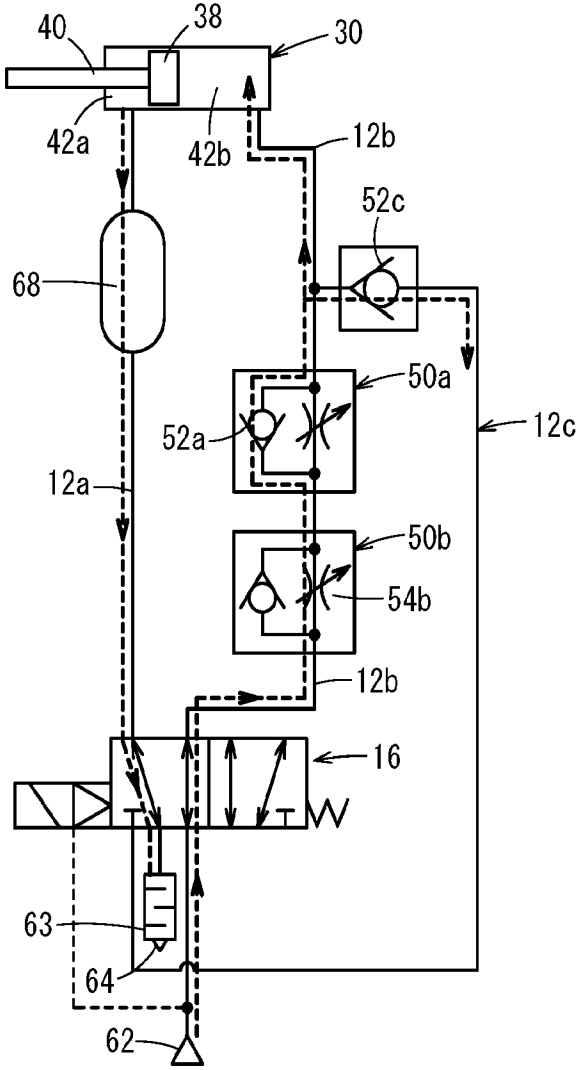
FIG. 1B illustrates a state of the first fluid circuit during a drive process.
Figure 1A:
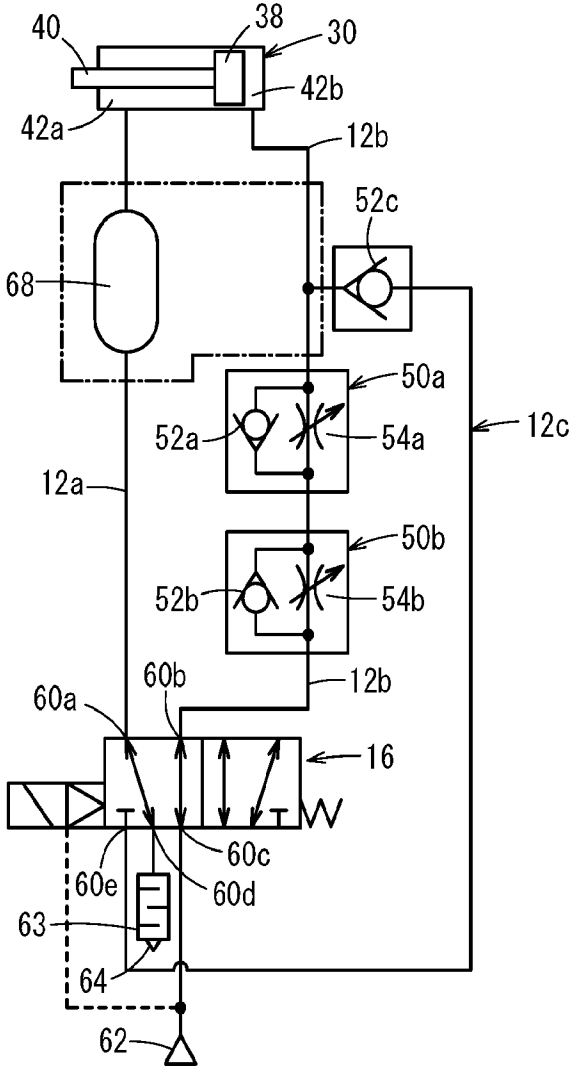
FIG. 1A is a circuit diagram of a fluid circuit (first fluid circuit) of an air cylinder according to a first embodiment when a switching valve of the first fluid circuit is in a first state.

As illustrated in FIG. 1A, the first fluid circuit 10A includes a first air path 12*a*, a second air path 12*b*, and a switching valve 16.

Figure 3:
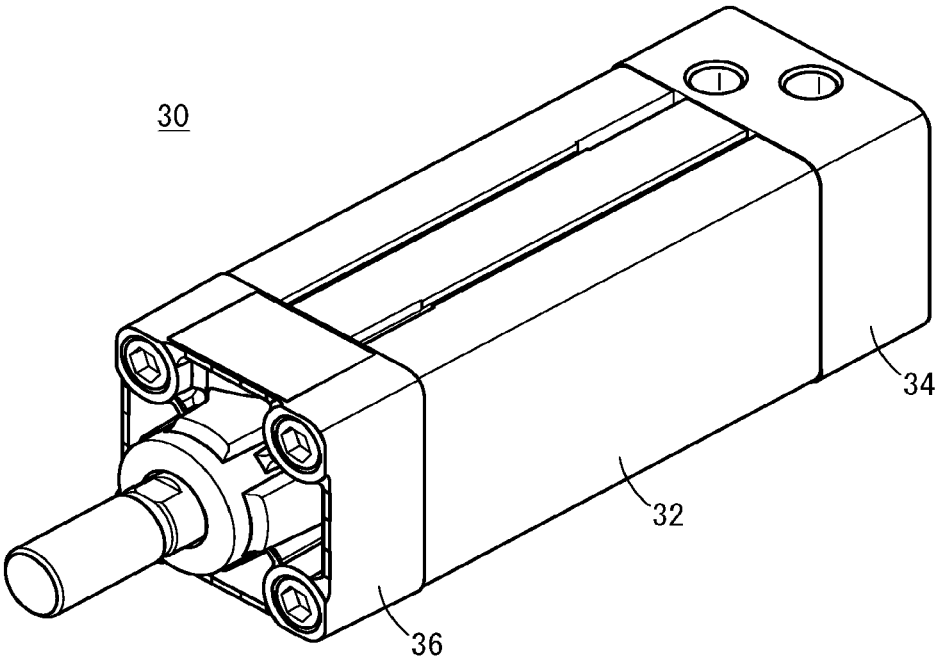
FIG. 3 is a perspective view of an example external appearance of the air cylinder.
Figure 4:
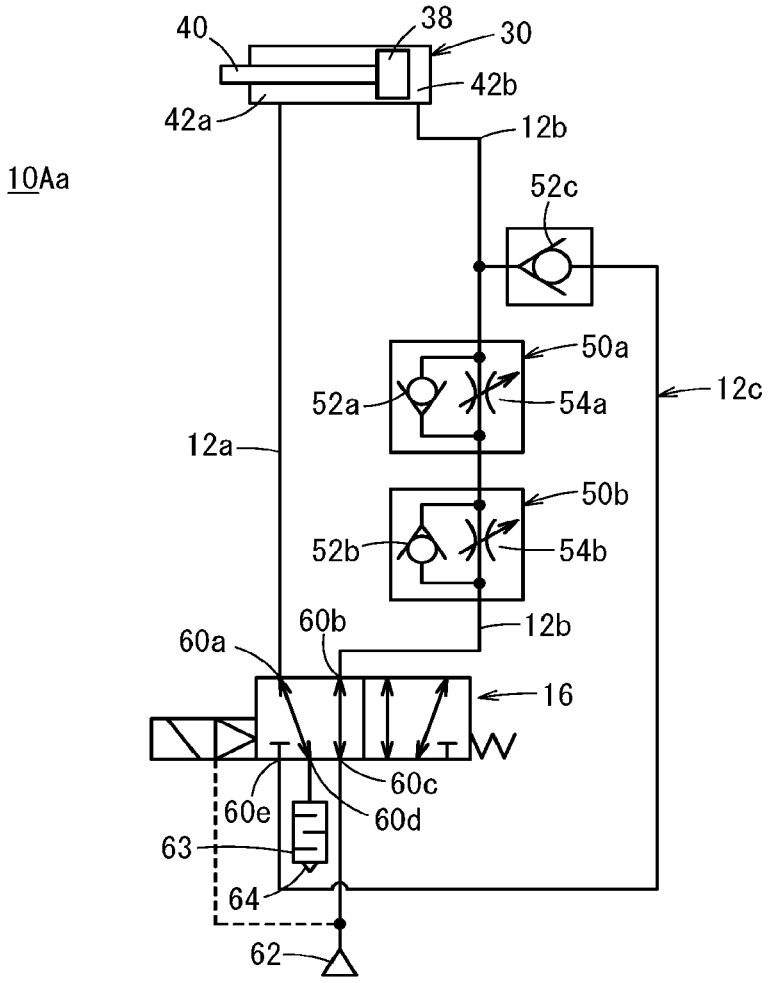
FIG. 4 is a circuit diagram of a modification of the first fluid circuit.

An air cylinder 30 includes a cylinder tube 32, a head cover 34, and a rod cover 36 as illustrated in FIG. 3, and a piston 38, a piston rod 40, and other components as illustrated in FIG. 1A. A first end of the cylinder tube 32 is closed by the rod cover 36, and a second end of the cylinder tube 32 is closed by the head cover 34. The piston 38 (see FIG. 1A) is disposed inside the cylinder tube 32 to be reciprocable. As illustrated in FIG. 1A, for example, the interior space of the cylinder tube 32 is partitioned into a first air chamber 42*a* formed between the piston 38 and the rod cover 36, and a second air chamber 42*b* formed between the piston 38 and the head cover 34.

The piston rod 40 connected to the piston 38 passes through the first air chamber 42*a*, and an end part of the piston rod 40 extends to the outside through the rod cover 36. The air cylinder 30 performs tasks such as positioning of workpieces (not illustrated) while pushing out the piston rod 40 (while the piston rod 40 extends), and does not perform any tasks while retracting the piston rod 40.

The first air path 12*a* is disposed between the first air chamber 42*a* of the air cylinder 30 and the switching valve 16. The second air path 12*b* is disposed between the second air chamber 42*b* of the air cylinder 30 and the switching valve 16.

Two speed control valves (a first speed control valve 50*a* and a second speed control valve 50*b*) are disposed on certain points on the second air path 12*b*. The first speed control valve 50*a* is an adjustable throttle valve of a so-called meter-out type and allows manual adjustment of the flow rate of air discharged from the second air chamber 42*b*. On the other hand, the second speed control valve 50*b* is an adjustable throttle valve of a so-called meter-in type and allows manual adjustment of the flow rate of air supplied to the second air chamber 42*b*. For the air accumulated in the second air chamber 42*b*, the ratio of the amount of air supplied to the first air chamber 42*a* to the amount of air discharged to the outside can be adjusted by operating the first speed control valve 50*a*.

The first speed control valve 50*a* includes a first check valve 52*a* and a first throttle valve 54*a* connected in parallel.

The first check valve 52*a* allows air to flow toward the second air chamber 42*b* of the air cylinder 30 via the switching valve 16 and stops air flowing from the second air chamber 42*b* of the air cylinder 30 toward the switching valve 16. The first throttle valve 54*a* adjusts the flow rate of air flowing from the second air chamber 42*b* of the air cylinder 30 toward the switching valve 16.

The second speed control valve 50*b* includes a second check valve 52*b* and a second throttle valve 54*b* connected in parallel. The second check valve 52*b* allows air to flow from the second air chamber 42*b* of the air cylinder 30 toward the switching valve 16 and stops air flowing toward the second air chamber 42*b* of the air cylinder 30 via the switching valve 16. The second throttle valve 54*b* adjusts the flow rate of air flowing toward the second air chamber 42*b* of the air cylinder 30 via the switching valve 16.

In the first fluid circuit 10A, a third check valve 52*c* is connected to a point on the second air path 12*b* between the air cylinder 30 and the first speed control valve 50*a*. The third check valve 52*c* allows air to flow from the second air path 12*b* toward the switching valve 16 and stops air flowing from the switching valve 16 toward the second air path 12*b*.

On the other hand, the switching valve 16 is configured as a 5-port, 2-position solenoid valve having a first port 60*a* to a fifth port 60*e* and switchable between a first position and a second position. The first port 60*a* is connected to the first air path 12*a*. The second port 60*b* is connected to the second air path 12*b*. The third port 60*c* is connected to an air supply source 62. The fourth port 60*d* is connected to an exhaust port 64 with a silencer 63 attached thereto. The fifth port 60*e* is connected to the third check valve 52*c* described above. Moreover, the first port 60*a* is connected to the fourth port 60*d*, and the second port 60*b* is connected to the third port 60*c*. A third air path 12*c* extending from the third check valve 52*c* to the fifth port 60*e* of the switching valve 16 functions as one air storage.

As illustrated in FIG. 1A, when the switching valve 16 is in the first position, the first port 60*a* is connected to the fourth port 60*d*, and the second port 60*b* is connected to the third port 60*c*. On the other hand, as illustrated in FIG. 2A, when the switching valve 16 is in the second position, the first port 60*a* is connected to the fifth port 60*e*, and the second port 60*b* is connected to the fourth port 60*d*.

The switching valve 16 is held in the second position by the biasing force of a spring while being de-energized, and switches from the second position to the first position when energized. The switching valve 16 is energized in response to a command to energize (energization) issued to the switching valve 16 by a PLC (Programmable Logic Controller; not illustrated), which is a higher level device, and is de-energized in response to a command to stop energizing (de-energization).

The switching valve 16 is in the first position during the drive process of the air cylinder 30, in which the piston rod 40 is pushed out, and is in the second position during the return process of the air cylinder 30, in which the piston rod 40 is retracted.

A tank portion 68 is disposed on a point on the first air path 12*a*. The tank portion 68 has a large volume to function as an air tank that accumulates air.

FIGS. 1A to 2B conceptually illustrate the first fluid circuit 10A using circuit diagrams. Some flow paths incorporated in the air cylinder 30 are drawn as if the flow paths were disposed outside the air cylinder 30 for convenience.

In practice, the section enclosed by alternate long and short dash lines in FIG. 1A, that is, part of the second air path 12*b* including the third check valve 52*c* and part of the first air path 12*a* including the tank portion 68 are incorporated in the air cylinder 30.

Moreover, for example, the first air path 12*a* in the section enclosed by the alternate long and short dash lines in FIG. 1A extends through the rod cover 36, the cylinder tube 32, and the head cover 34 as illustrated in FIG. 3. The part of the section disposed inside the cylinder tube 32 corresponds to the tank portion 68. For example, the cylinder tube 32 may have a double-layered structure including an inner tube and an outer tube so that the space left between the inner and outer tubes serves as the tank portion 68.

The first fluid circuit 10A is basically configured as above. The effects thereof will now be described with reference to FIGS. 1A to 2B. A state where the piston rod 40 is retracted the most while the switching valve 16 is in the first position as illustrated in FIG. 1A is defined as an initial state.

First, as illustrated in FIGS. 1A and 1B, during the drive process, air from the air supply source 62 is supplied to the second air chamber 42*b* via the second air path 12*b* in the initial state. This causes air inside the first air chamber 42*a* to be discharged from the exhaust port 64 to the outside via the first air path 12*a*. At this moment, air passes through the second speed control valve 50*b* while the flow rate is adjusted by the second throttle valve 54*b*, and then is supplied to the second air chamber 42*b* via the first check valve 52*a* of the first speed control valve 50*a*. The air from the air supply source 62 is also supplied from the second air path 12*b* to the third air path 12*c* via the third check valve 52*c*.

This causes the pressure in the second air chamber 42*b* to start increasing and the pressure in the first air chamber 42*a* to start dropping. When the pressure in the second air chamber 42*b* exceeds the pressure in the first air chamber 42*a* by an amount to overcome static frictional resistance of the piston 38, the piston rod 40 starts moving in a push-out direction. Then, as illustrated in FIG. 1B, the piston rod 40 extends to the maximum position and is held in the position by a large thrust.

Figure 2B:
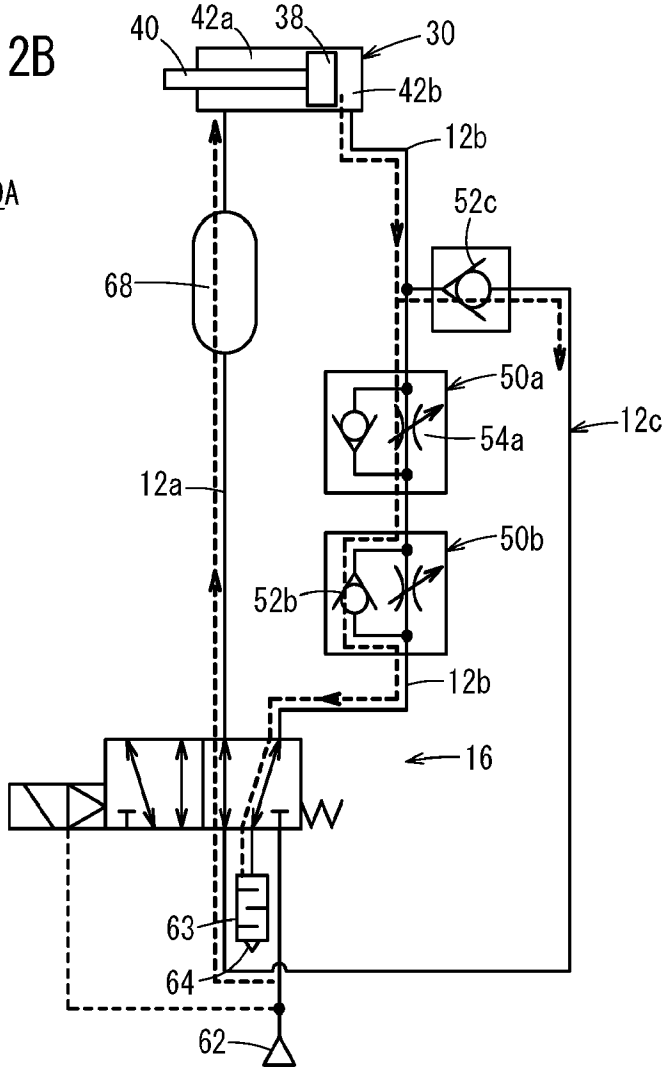
FIG. 2B illustrates a state of the first fluid circuit during a return process.
Figure 2A:
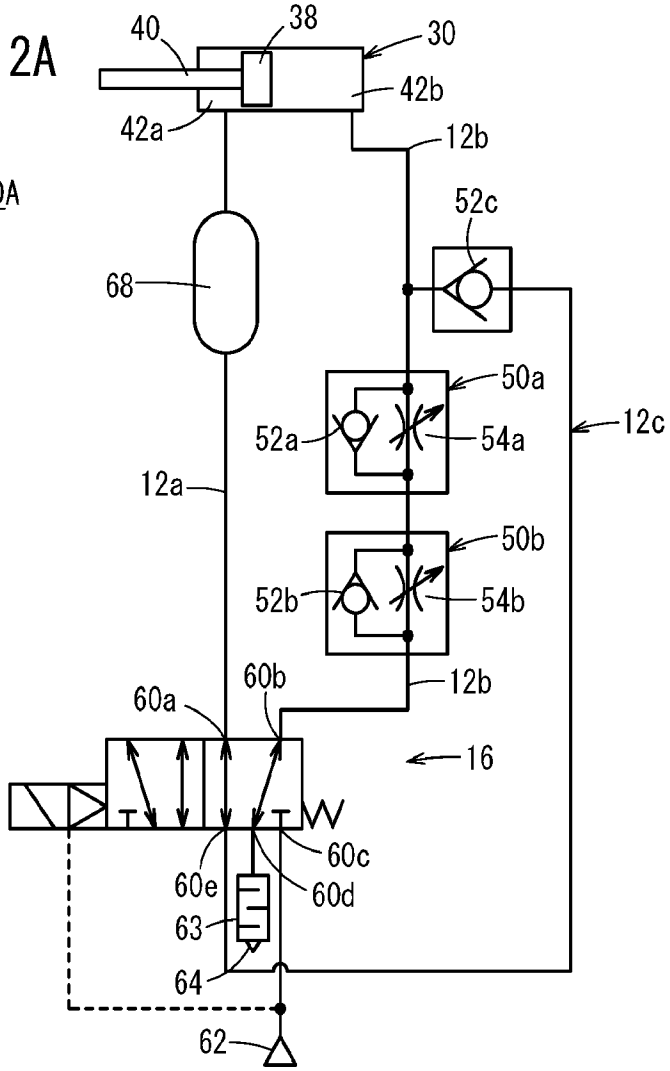
FIG. 2A is a circuit diagram when the switching valve of the first fluid circuit is in a second state.

After the piston rod 40 extends and a task such as positioning of a workpiece is performed, the switching valve 16 is switched from the first position to the second position as illustrated in FIGS. 2A and 2B. That is, the return process of the piston rod 40 starts.

During the return process, part of the air accumulated in the second air chamber 42*b* passes through the third check valve 52*c* and flows toward the first air chamber 42*a*. At the same time, another part of the air accumulated in the second air chamber 42*b* is discharged from the exhaust port 64 via the first speed control valve 50*a*, the second speed control valve 50*b*, and the switching valve 16. At this moment, air passes through the first speed control valve 50*a* while the flow rate is adjusted by the first throttle valve 54*a*, and then flows toward the switching valve 16 via the second check valve 52*b* of the second speed control valve 50*b*.

On the other hand, the air supplied toward the first air chamber 42*a* is accumulated mainly in the tank portion 68. This is because the tank portion 68 occupies the largest space in an area where air can exist between the third check valve 52*c* and the first air chamber 42*a* including the first air chamber 42*a* and the pipes path before retraction of the piston rod 40 starts.

Subsequently, the air pressure in the second air chamber 42*b* decreases while the air pressure in the first air chamber 42*a* increases. When the air pressure in the first air chamber 42*a* becomes higher than the air pressure in the second air chamber 42*b* by a predetermined amount or more, retraction of the piston rod 40 starts. Then, the first fluid circuit 10A returns to its initial state where the piston rod 40 is retracted the most.

In the example of the first fluid circuit 10A, the tank portion 68 is disposed on the first air path 12*a*. However, the tank portion 68 may be omitted as in a first fluid circuit 10Aa according to a modification illustrated in FIG. 4 in the case where the inner diameter of the first air path 12*a* is sufficiently large to function as the tank portion 68.

Next, a fluid circuit of an air cylinder according to a second embodiment (hereinafter referred to as "second fluid circuit 10B") will be described with reference to FIGS. 5A to 7.

The second fluid circuit 10B has a structure almost identical to the structure of the first fluid circuit 10A described above except that the second fluid circuit 10B includes a bypass path 80 instead of the third air path 12*c*.

That is, in the second fluid circuit 10B, the bypass path 80 branches off from a point on the first air path 12*a* and joins the second air path 12*b* at a point on the second air path 12*b*. That is, the bypass path 80 is disposed between a point M1 on the first air path 12*a* and a point M2 on the second air path 12*b*.

The bypass path 80 is provided with a fourth check valve 52*d* disposed adjacent to the point M2 on the second air path 12*b*, and a pilot check valve 56 disposed adjacent to the point M1 on the first air path 12*a*. The fourth check valve 52*d* allows air to flow from the second air chamber 42*b* toward the first air chamber 42*a* and stops air flowing from the first air chamber 42*a* toward the second air chamber 42*b*.

The pilot check valve 56 allows air to flow from the first air chamber 42*a* toward the second air chamber 42*b*. Moreover, the pilot check valve 56 stops air flowing from the second air chamber 42*b* toward the first air chamber 42*a* when not subjected to pilot pressure at a predetermined level or above, and allows air to flow from the second air chamber 42*b* toward the first air chamber 42*a* when subjected to pilot pressure at the predetermined level or above. In other words, when not subjected to pilot pressure, the pilot check valve 56 functions as a check valve allowing air to flow from the first air chamber 42*a* toward the second air chamber 42*b* and stopping air flowing from the second air chamber 42*b* toward the first air chamber 42*a*. When subjected to pilot pressure, the pilot check valve 56 does not function as a check valve and allows air to flow in either direction.

A fifth check valve 52*e* is disposed on a point on the first air path 12*a* between the point M1 on the first air path 12*a* and the switching valve 16. The fifth check valve 52*e* allows air to flow from the point M1 on the first air path 12*a* toward the switching valve 16 and stops air flowing from the switching valve 16 toward the point M1 on the first air path 12*a*. A pilot path 58 branches off from the first air path 12*a* at a point between the fifth check valve 52*e* and the switching valve 16 and connects to the pilot check valve 56.

The switching valve 16 in the second fluid circuit 10B is also configured as a 5-port, 2-position solenoid valve having the first port 60*a* to the fifth port 60*e* and switchable between the first position and the second position. The first port 60*a* is connected to the first air path 12*a*. The second port 60*b* is connected to the second air path 12*b*.

The third port 60*c* is connected to a first exhaust port 64*a* with a first silencer 63*a* attached thereto. The fourth port 60*d* is connected to the air supply source 62. The fifth port 60*e* is connected to a second exhaust port 64*b* with a second silencer 63*b* attached thereto.

Figure 5B:
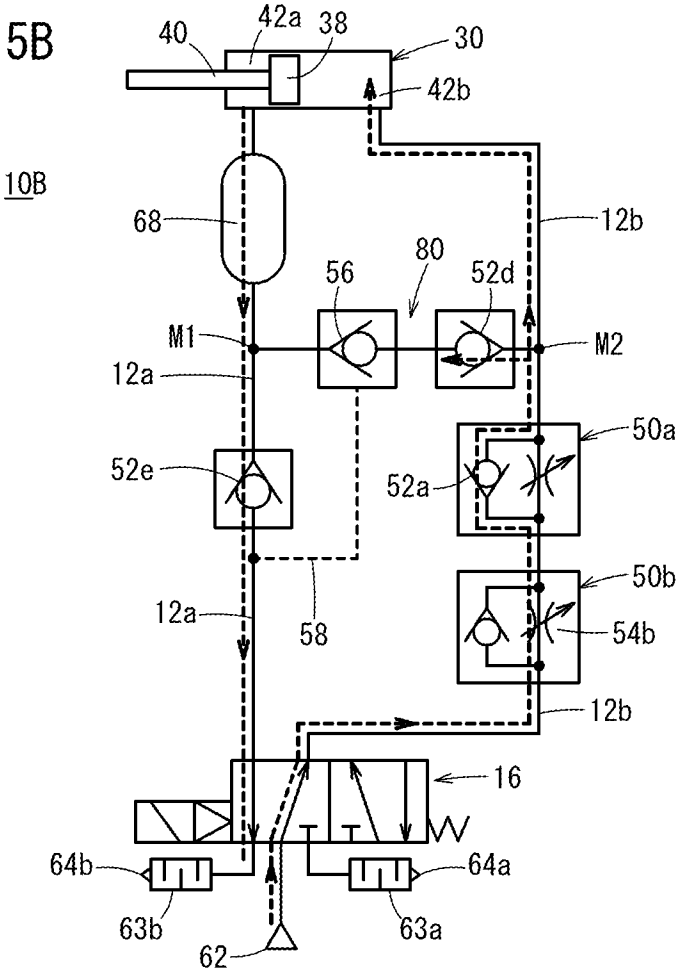
FIG. 5B illustrates a state of the second fluid circuit during a drive process.
Figure 5A:
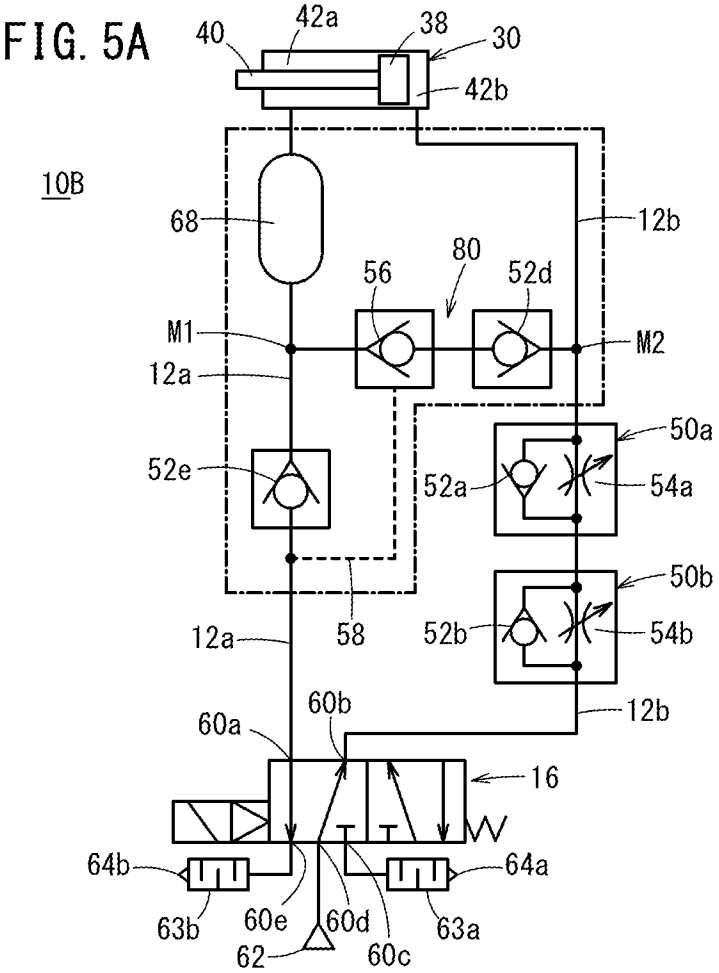
FIG. 5A is a circuit diagram of a fluid circuit (second fluid circuit) of an air cylinder according to a second embodiment when a switching valve of the second fluid circuit is in a first state.

The section enclosed by alternate long and short dash lines in FIG. 5A, that is, the tank portion 68, the bypass path 80 including the fourth check valve 52*d* and the pilot check valve 56, the pilot path 58, part of the first air path 12*a* including the fifth check valve 52*e*, and part of the second air path 12*b* are incorporated in the air cylinder 30.

The second fluid circuit 10B is basically configured as above. The effects thereof will now be described with reference to FIGS. 5A to 6B. A state where the piston rod 40 is retracted the most while the switching valve 16 is in the first position as illustrated in FIG. 5A is defined as an initial state.

First, as illustrated in FIGS. 5A and 5B, during the drive process, air from the air supply source 62 is supplied to the second air chamber 42*b* via the second air path 12*b* in the initial state. This causes air inside the first air chamber 42*a* to be discharged from the second exhaust port 64*b* to the outside via the first air path 12*a*. At this moment, air passes through the second speed control valve 50*b* while the flow rate is adjusted by the second throttle valve 54*b*, and then is supplied to the second air chamber 42*b* via the first check valve 52*a* of the first speed control valve 50*a*.

This causes the pressure in the second air chamber 42*b* to start increasing and the pressure in the first air chamber 42*a* to start dropping. When the pressure in the second air chamber 42*b* exceeds the pressure in the first air chamber 42*a* by an amount to overcome static frictional resistance of the piston 38, the piston rod 40 starts moving in the push-out direction. Then, as illustrated in FIG. 5B, the piston rod 40 extends to the maximum position and is held in the position by a large thrust.

Figure 6B:
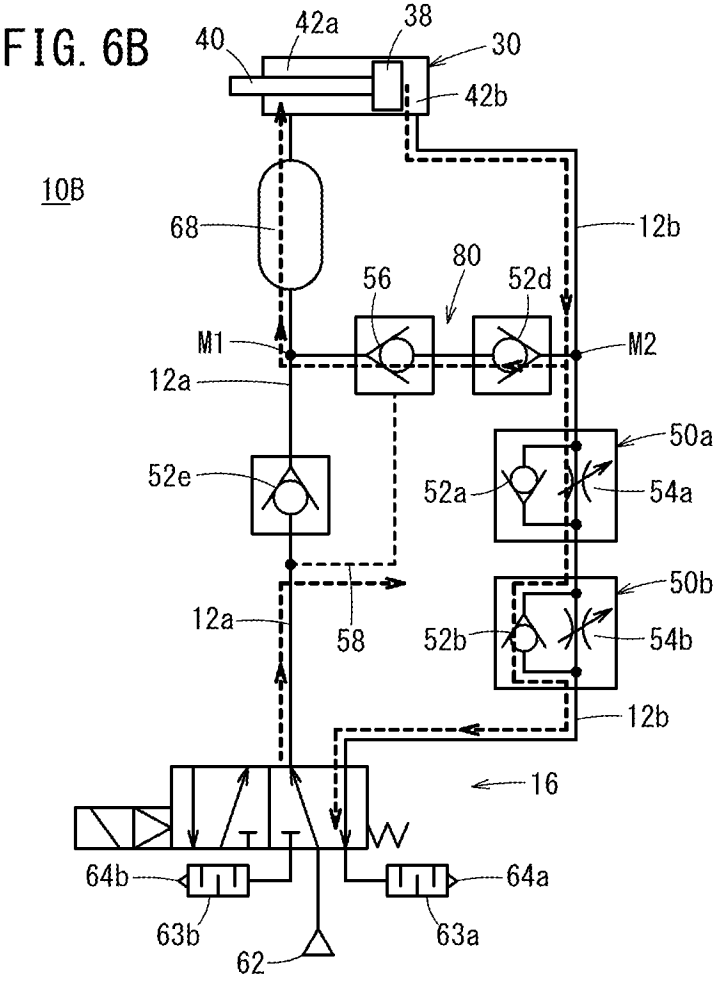
FIG. 6B illustrates a state of the second fluid circuit during a return process.
Figure 6A:
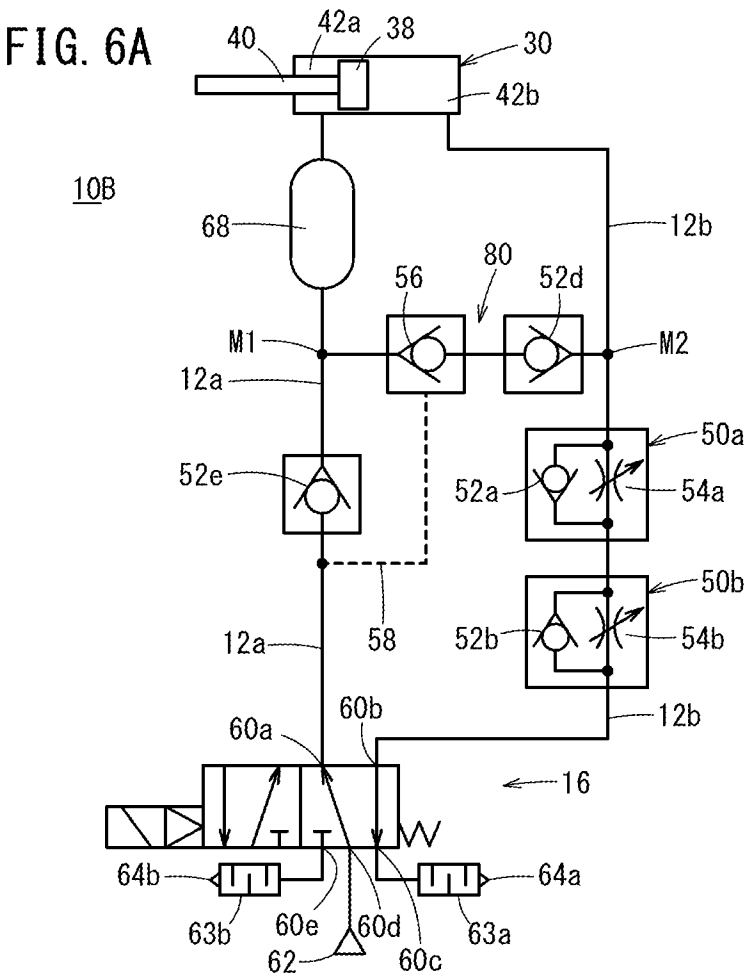
FIG. 6A is a circuit diagram when the switching valve of the second fluid circuit is in a second state.
Figure 7:
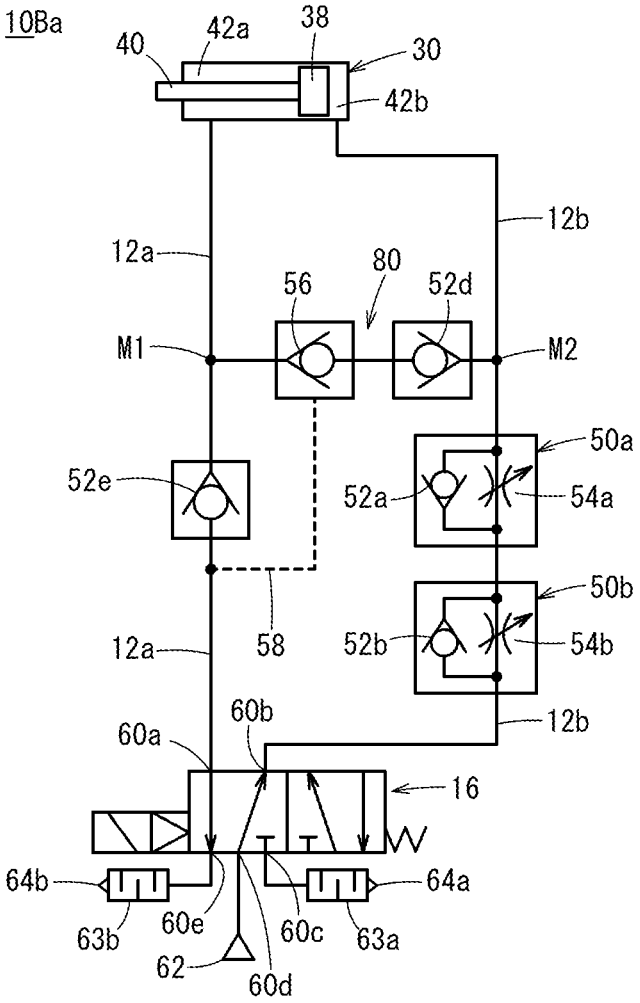
FIG. 7 is a circuit diagram of a modification of the second fluid circuit.

After the piston rod 40 extends and a task such as positioning of a workpiece is performed, the switching valve 16 is switched from the first position to the second position as illustrated in FIG. 6A. That is, the return process of the piston rod 40 starts.

During the return process, air from the air supply source 62 flows into part of the first air path 12*a* between the fifth check valve 52*e* and the switching valve 16. The pressure of the air inside the part of the first air path 12*a* increases as the fifth check valve 52*e* blocks the air flow. Then, the pressure in the pilot path 58 connected to the first air path 12*a* becomes higher than or equal to a predetermined level, causing the pilot check valve 56 to stop functioning as a check valve.

When the pilot check valve 56 stops functioning as a check valve, part of the air accumulated in the second air chamber 42*b* passes through the bypass path 80 including the fourth check valve 52*d* and the pilot check valve 56 via the point M2 on the second air path 12*b*, and is supplied from the point M1 on the first air path 12*a* toward the first air chamber 42*a*. At the same time, another part of the air accumulated in the second air chamber 42*b* is discharged from the first exhaust port 64*a* to the outside via the second air path 12*b*. At this moment, air passes through the first speed control valve 50*a* while the flow rate is adjusted by the first throttle valve 54*a*, and then flows toward the switching valve 16 via the second check valve 52*b* of the second speed control valve 50*b*. This causes the pressure in the second air chamber 42*b* to start dropping and the pressure in the first air chamber 42*a* to start increasing. At this moment, the air supplied toward the first air chamber 42*a* is accumulated mainly in the tank portion 68.

The pressure in the second air chamber 42*b* decreases while the pressure in the first air chamber 42*a* increases. When the pressure in the second air chamber 42*b* becomes equal to the pressure in the first air chamber 42*a*, supply of the air in the second air chamber 42*b* toward the first air chamber 42*a* stops due to the effect of the fourth check valve 52*d*. This causes the pressure in the first air chamber 42*a* to stop increasing. On the other hand, the pressure in the second air chamber 42*b* continues to drop. When the pressure in the first air chamber 42*a* exceeds the pressure in the second air chamber 42*b* by an amount to overcome the static frictional resistance of the piston 38, the piston rod 40 starts moving in a retraction direction.

When the piston rod 40 starts moving in the retraction direction, the volume of the first air chamber 42*a* increases, and thus the pressure in the first air chamber 42*a* drops. However, the rate of the pressure drop is slow as the volume of the first air chamber 42*a* is substantially increased by the presence of the tank portion 68. As the pressure in the second air chamber 42*b* drops at a higher rate than the above, the pressure in the first air chamber 42*a* continues to exceed the pressure in the second air chamber 42*b*. In addition, the sliding resistance of the piston 38 that has once started moving is less than the frictional resistance of the piston 38 at rest. Thus, the piston rod 40 can move in the retraction direction without any difficulty. In this manner, the second fluid circuit 10B returns to its initial state where the piston rod 40 is retracted the most. The second fluid circuit 10B is maintained in this state until the switching valve 16 is switched again.

In the example of the second fluid circuit 10B, the tank portion 68 is disposed on the first air path 12*a*. However, the tank portion 68 may be omitted as in a second fluid circuit 10Ba according to another modification illustrated in FIG. 7 in the case where the inner diameter of part of the first air path 12*a* between the fifth check valve 52*e* and the first air chamber 42*a* is sufficiently large to function as the tank portion 68.

[Invention Derived from Embodiments]

The invention that can be understood from the above-described embodiments will be described below.

The fluid circuit of the air cylinder of the embodiments includes the air cylinder 30 including the first air chamber 42*a* and the second air chamber 42*b* partitioned by the piston 38, the switching valve 16 configured to switch between the position for the drive process of the piston 38 and the position for the return process of the piston 38, the first air path 12*a* disposed between the first air chamber 42*a* and the switching valve 16, and the second air path 12*b* disposed between the second air chamber 42*b* and the switching valve 16. The two speed control valves (the first speed control valve 50*a* and the second speed control valve 50*b*) are disposed in series on the second air path 12*b*.

During the drive process of the piston 38, the supply rate from the switching valve 16 to the second air chamber 42*b* can be adjusted by the second throttle valve 54*b* of the second speed control valve 50*b*. During the return process of the piston 38, the discharge rate from the second air chamber 42*b* to the switching valve 16 can be adjusted by the first throttle valve 54*a* of the first speed control valve 50*a*. That is, the supply rate to the air cylinder 30 and the discharge rate from the air cylinder 30 can be adjusted independently. This leads to a reduction in the stroke time during the drive process and an increase in the pressure inside a fluid pressure cylinder after the return process, which are required characteristics of the fluid circuit. In addition, this can be achieved by simply arranging the two speed control valves in series on the second air path 12*b*, also leading to simplification of the structure.

In the embodiments, the first check valve 52*a* of the first speed control valve 50*a* and the second throttle valve 54*b* of the second speed control valve 50*b* constitute the second air path 12*b* during the drive process, and the first throttle valve 54*a* of the first speed control valve 50*a* and the second check valve 52*b* of the second speed control valve 50*b* constitute the second air path 12*b* during the return process.

During the drive process, air supplied to the second air path 12*b* flows through the first check valve 52*a* of the first speed control valve 50*a* and the second throttle valve 54*b* of the second speed control valve 50*b*. The air is then supplied to the second air chamber 42*b* of the air cylinder 30. During the return process, air discharged from the second air chamber 42*b* of the air cylinder 30 to the second air path 12*b* flows through the first throttle valve 54*a* of the first speed control valve 50*a* and the second check valve 52*b* of the second speed control valve 50*b*. The air is then discharged via the switching valve 16. Thus, the supply rate from the switching valve 16 to the second air chamber 42*b* can be adjusted by the second throttle valve 54*b* of the second speed control valve 50*b* during the drive process of the piston 38, and the discharge rate from the second air chamber 42*b* to the switching valve 16 can be adjusted by the first throttle valve 54*a* of the first speed control valve 50*a* during the return process of the piston 38.

In the embodiments, the fluid circuit may include the third air path 12*c* branching off from the second air path 12*b* and extending toward the switching valve 16, and the third check valve 52*c* (external check valve) disposed on the third air path 12*c* such that the inlet of the third check valve 52*c* faces the second air path 12*b*. The third air path 12*c* may store part of air supplied from the second air path 12*b* during the drive process and may connect the second air path 12*b* and the first air path 12*a* via the switching valve 16 during the return process.

During the drive process, the part of the air supplied from the second air path 12*b* to the third air path 12*c* is stored in the third air path 12*c*. During the subsequent return process, the air stored in the third air path 12*c* is supplied to the first air chamber 42*a* of the air cylinder 30 via the switching valve 16 and the first air path 12*a*. That is, the air stored in the third air path 12*c* can be used as the pressure to return the piston 38, leading to a reduction in the air consumption.

In the embodiments, the fluid circuit may include the bypass path 80 disposed between the first air path 12*a* and the second air path 12*b*, and the fourth check valve 52*d* (internal check valve) and the pilot check valve 56 (internal pilot check valve) disposed on the bypass path 80. The fourth check valve 52*d* may allow air to flow from the second air chamber 42*b* toward the first air chamber 42*a* and stop air flowing from the first air chamber 42*a* toward the second air chamber 42*b*. The pilot check valve 56 may allow air to flow from the first air chamber 42*a* toward the second air chamber 42*b* and stop air flowing from the second air chamber 42*b* toward the first air chamber 42*a* when the pilot check valve 56 is not subjected to pilot pressure.

This enables the air accumulated in the second air chamber 42*b* to be supplied toward the first air chamber 42*a* and, at the same time, to be discharged to the outside. As the pressure in the first air chamber 42*a* increases while the pressure in the second air chamber 42*b* decreases quickly, the time required to return the air cylinder 30 can be reduced as much as possible. Moreover, since no collection valve with a complex structure is required, the fluid circuit to return the air cylinder 30 can be simplified.

In the embodiments, the tank portion 68 may be disposed on the first air path 12*a* adjacent to the first air chamber 42*a*. This enables air discharged from the second air chamber 42*b* to be accumulated in the tank portion 68 and prevents the pressure in the first air chamber 42*a* from decreasing as much as possible when the volume of the first air chamber 42*a* increases during the return process of the air cylinder 30.

The fluid circuit of the air cylinder according to the present invention is not limited in particular to the embodiments described above, and may have various structures without departing from the scope of the present invention as a matter of course.

The invention claimed is:

1. A fluid circuit of an air cylinder, comprising:

an air cylinder including a first air chamber and a second air chamber partitioned by a piston:

a switching valve configured to switch between a position for a drive process of the piston and a position for a return process of the piston;

a first flow path disposed between the first air chamber and the switching valve; and a second flow path disposed between the second air chamber and the switching valve, wherein two speed control valves are disposed in series on the second flow path, and a tank portion is disposed on the first flow path adjacent to the first air chamber.

2. The fluid circuit of the air cylinder according to claim 1, wherein during the drive process, a check valve of one speed control valve of the two speed control valves and an adjustable throttle valve of another speed control valve constitute the second flow path; and during the return process, an adjustable throttle valve of the one speed control valve and a check valve of the another speed control valve constitute the second flow path.

3. The fluid circuit of the air cylinder according to claim 1, further comprising:

a third flow path branching off from the second flow path and extending toward the switching valve; and an external check valve disposed on the third flow path, an inlet of the external check valve facing the second flow path, wherein:

during the drive process, the third flow path stores part of air supplied from the second flow path; and during the return process, the third flow path connects the second flow path and the first flow path via the switching valve.

4. The fluid circuit of the air cylinder according to claim 1, further comprising:

a bypass path disposed between the first flow path and the second flow path; and an internal check valve and an internal pilot check valve disposed on the bypass path, wherein:

the internal check valve allows air to flow from the second air chamber toward the first air chamber and stops air flowing from the first air chamber toward the second air chamber, while the internal pilot check valve allows air to flow from the first air chamber toward the second air chamber and stops air flowing from the second air chamber toward the first air chamber when the internal pilot check valve is not subjected to pilot pressure.

* * * * *